US008516659B2

(12) United States Patent
Wing

(10) Patent No.: US 8,516,659 B2
(45) Date of Patent: Aug. 27, 2013

(54) REFRIGERATOR HANDLE MOUNTING ARRANGEMENT HAVING PIN AND CAVITY INTERLOCK

(75) Inventor: Forrest F. Wing, Des Moines, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 2176 days.

(21) Appl. No.: 11/033,531

(22) Filed: Jan. 12, 2005

(65) Prior Publication Data

US 2006/0152120 A1 Jul. 13, 2006

(51) Int. Cl.
*E05B 1/00* (2006.01)

(52) U.S. Cl.
USPC ..... 16/412; 16/436

(58) Field of Classification Search
USPC ..... 16/412, 413, 436, 443, 444, DIG. 40, 16/DIG. 41; 248/254, 278.1, 256, 257, 282.1, 248/261; 411/52, 53; 49/460, 461; 312/248.6, 312/401, 405; 403/381, 361
See application file for complete search history.

(56) References Cited

U.S. PATENT DOCUMENTS

| | | | | |
|---|---|---|---|---|
| 2,469,893 | A | 5/1944 | Rockwell | |
| 2,458,754 | A | 10/1945 | Wallace | |
| 2,472,479 | A | 6/1946 | Hoff | |
| 2,459,658 | A | 11/1947 | Klein | |
| 2,870,493 | A | 4/1957 | Beyrle | |
| 3,766,598 | A * | 10/1973 | Roberts | 16/444 |
| 4,404,709 | A | 9/1983 | Janz et al. | |
| 4,745,656 | A | 5/1988 | Revlett | |
| 4,922,576 | A * | 5/1990 | Weidner et al. | 16/413 |
| 4,926,523 | A | 5/1990 | Carlson et al. | |
| 5,402,553 | A | 4/1995 | Goetz et al. | |
| 5,493,756 | A | 2/1996 | Shanok et al. | |
| 5,659,927 | A | 8/1997 | Shanok et al. | |
| 5,797,164 | A * | 8/1998 | Donaghy | 16/412 |
| 6,019,447 | A * | 2/2000 | Jackovin | 312/405 |
| 6,609,274 | B2 * | 8/2003 | Christensen et al. | 16/412 |
| 6,629,339 | B2 | 10/2003 | Pohl et al. | |
| 6,708,374 | B2 | 3/2004 | Mandel | |
| 6,871,385 | B2 * | 3/2005 | Wing et al. | 16/436 |
| 6,926,379 | B1 * | 8/2005 | Grace et al. | 312/405 |
| 2003/0145433 | A1 | 8/2003 | Mandel | |
| 2006/0143865 | A1 * | 7/2006 | Magyar et al. | 16/412 |

* cited by examiner

*Primary Examiner* — Chuck Y. Mah
(74) *Attorney, Agent, or Firm* — Kirk W. Goodwin; Diederiks & Whitelaw PLC

(57) ABSTRACT

A handle assembly is provided for a refrigerator door including a side edge defined by an upper inner edge portion and a lower inner edge portion which are offset by a lateral portion, front and back sides, and an opening between the front and back sides at the lateral portion. The handle assembly includes a handle having a first end leading to a second end through a gripping portion. The second end is provided with in-turned portion having a projection. The handle assembly also includes an attachment member fixed to the front side of the door and a cap positioned in the opening of the door. When assembled, the first end of the handle is secured to the attachment member and the projection extends into a socket formed in the cap.

16 Claims, 5 Drawing Sheets

REFRIGERATOR HANDLE MOUNTING ARRANGEMENT HAVING PIN AND CAVITY INTERLOCK

BACKGROUND OF THE INVENTION

1. Field of the Invention

The present invention pertains to the art of refrigerators and, more particularly, to a mounting arrangement for a handle on a refrigerator.

2. Discussion of the Prior Art

Conventional handle arrangements for refrigerators are formed from multiple pieces, including a handle frame and a handle piece having a gripping portion. Such a handle is typically mounted to a refrigerator cabinet utilizing screws which extend through the handle piece and frame, clamping the overall handle to a panel of the refrigerator cabinet. Once the handle is in place, a cover is inserted over each screw, with the cover extending only over the area of the screw or along substantially the entire length of the handle. In general, this known handle mounting arrangement is rather hard to assemble and often results in witness lines that take away from the overall aesthetics of the refrigerator.

In certain refrigerators, gas assist handles are employed in an attempt to simplify the construction and assembly, while also improving the aesthetics. Such handle arrangements are also considered advantageous given their characteristic soft feel. Regardless of these known arrangements, there still exists a need in the art for an improved arrangement for mounting a handle to a refrigerator in a manner which provides a tight, aesthetically appealing and easily assembled overall assembly.

SUMMARY OF THE INVENTION

The present invention pertains to the mounting of a handle assembly to a door face of a refrigerator. In accordance with the most preferred form of the invention, a base plate and door clip are initially attached to the face of the refrigerator, such as through the use of screws or the like. The base plate includes raised surfaces, preferably at longitudinally spaced positions. In addition, a cap member having a socket formed therein is attached to an in-turned portion of the door. Once the base plate, base clip, and cap member are secured, a portion of a handle is placed over the base plate and slid relative to the base plate whereupon the structure of the handle co-acts with the base plate to keep the handle against the door face. In addition, a clip attached to the handle engages the door clip to further secure the handle. As the handle is slid relative to the door, a projection extending from an end portion of the handle is received by the socket of the cap member, thereby securing the end portion of the handle. With this arrangement, all of the fasteners are hidden and witness lines, corresponding to those associated with conventional handle mounting arrangements, are avoided. In addition, the handle may be easily attached to the refrigerator door without the use of tools.

Additional objects, features and advantages of the present invention will be more readily apparent from the following detailed description of preferred embodiments of the invention, when taken in conjunction with the drawings wherein like reference numerals refer to corresponding parts in the several views.

DETAILED DESCRIPTION OF THE PREFERRED EMBODIMENT

Figure 1:
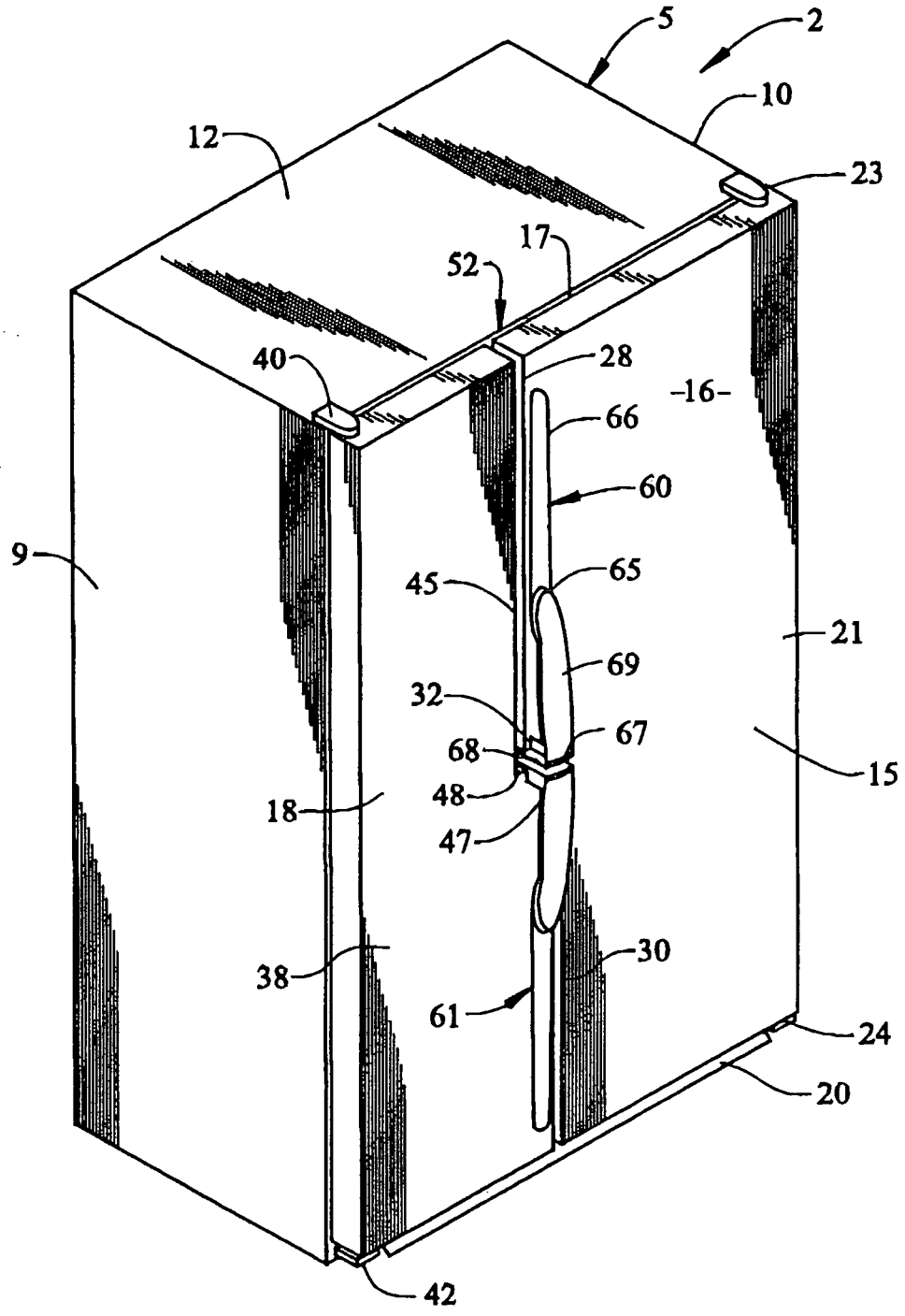
FIG. 1 is upper left perspective view of a refrigerator cabinet incorporating a refrigerator door handle arrangement constructed in accordance with a preferred embodiment of the present invention.

With initial reference to FIG. 1, the handle assembly of the invention is shown mounted to a refrigerator which is generally indicated at 2. Although the handle assembly can be applied to various different types and styles of refrigerators, as shown, refrigerator 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator 2 constitutes a side-by-side refrigerator having a fresh food compartment door 15 which is arranged laterally juxtaposed a freezer door 18. Extending laterally across cabinet shell 5, below fresh food and freezer doors 15 and 18 is a kickplate 20.

Fresh food door 15 includes a front side 16, a back side 17 and an outer vertical edge portion 21 which is pivotally attached to cabinet shell 5 through an upper hinge 23 and a lower hinge 24. In accordance with the present invention, fresh food door 15 includes an upper inner edge portion 28 and a lower inner edge portion 30 offset by a horizontal or lateral portion 32 (see also FIG. 2). Therefore, upper and lower inner edge portions 28 and 30 are laterally spaced and extend in vertically offset planes or axes. In a generally similar manner, freezer door 18 includes an outer edge portion 38 which is pivoted at upper hinge 40 and lower hinge 42 for movement relative to cabinet shell 5. In addition, freezer door 18 includes an upper inner edge portion 45 and a lower inner edge portion 47 offset by horizontal portion 48. Again, the exact construction of refrigerator 2 can vary greatly without departing from the invention.

As opposed to a more conventional side-by-side refrigerator wherein inner edge portions of the fresh food and freezer doors would be spaced by a single vertical axis gap, fresh food and freezer doors 15 and 18 of refrigerator 2 are spaced in a central zone by a gap 52 that includes a first vertical component between upper inner edge portions 28 and 45, a lateral component between the offset horizontal portions 32 and 48, and a second vertical component between lower inner edge portions 30 and 47. Therefore, fresh food door 15 is wider in an upper portion thereof than in a lower portion. Correspondingly, freezer door 18 is wider in a lower portion than in an upper portion. As will become more fully evident below, fresh food and freezer doors 15 and 18 conceal fresh food and freezer compartments of refrigerator 2 which also have varying width upper and lower sections in accordance with the present invention. In any event, further details of this basic structure of refrigerator 2 is provided in U.S. Pat. Nos. 6,019,447 and 6,629,339 which are incorporated herein by reference. Aside from the aspects which will be described more fully below, the basic construction and operation of refrigerator 2 is known in the art, does not form part of the present invention and therefore will not be discussed further herein.

The present invention is actually directed to the mounting of handle assemblies 60 and 61 for fresh food and freezer doors 15 and 18 respectively. Although the particular handle configuration can vary in accordance with the present invention, it is the particular mounting arrangement for one or more of handle assemblies 60 and 61 to which the present invention is directed. As shown, each handle assembly 60, 61 includes a first end 65 having an elongated extension 66 extending therefrom, a second end 67 having an in-turned portion 68, and an intermediate portion 69 interconnecting the first and second ends 65 and 67.

Figure 2:
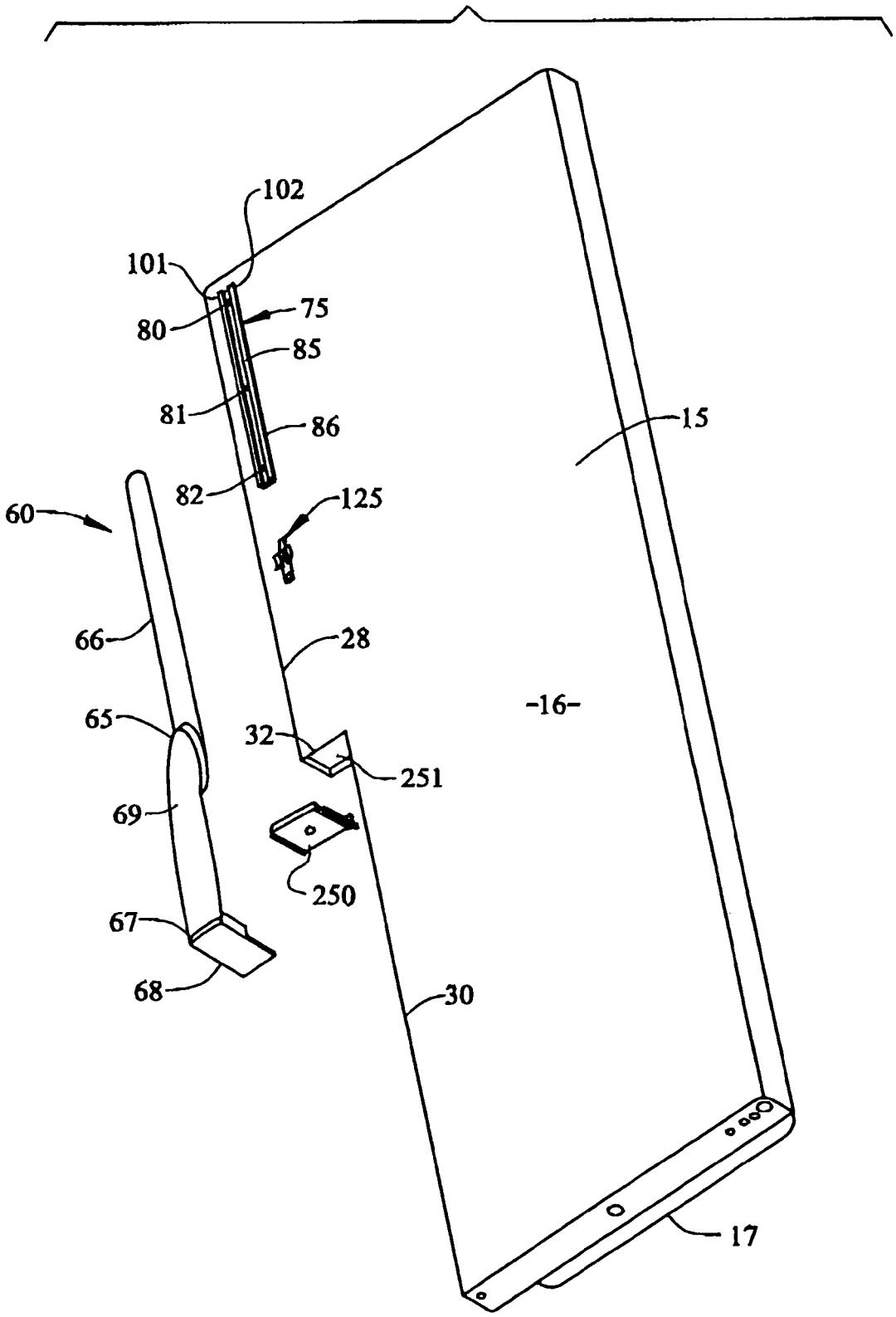
FIG. 2 is a partial exploded view of the handle arrangement of FIG. 1.
Figure 3:
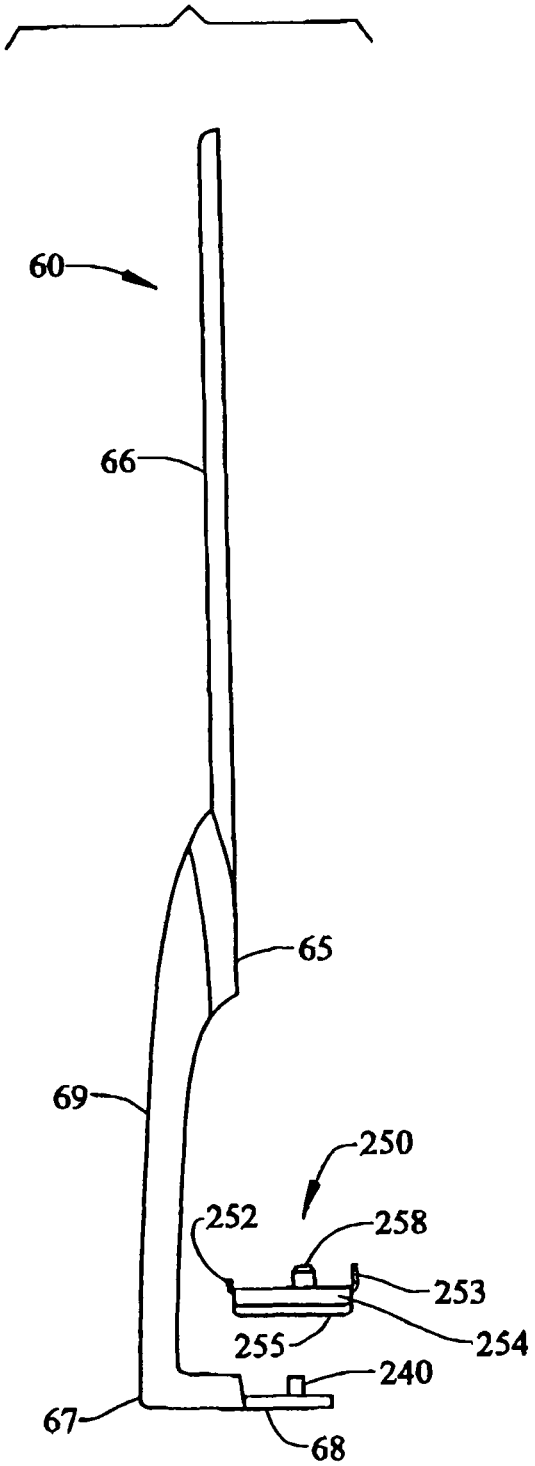
FIG. 3 is a side view of a handle member employed in the handle arrangement of FIGS. 1 and 2.
Figure 4:
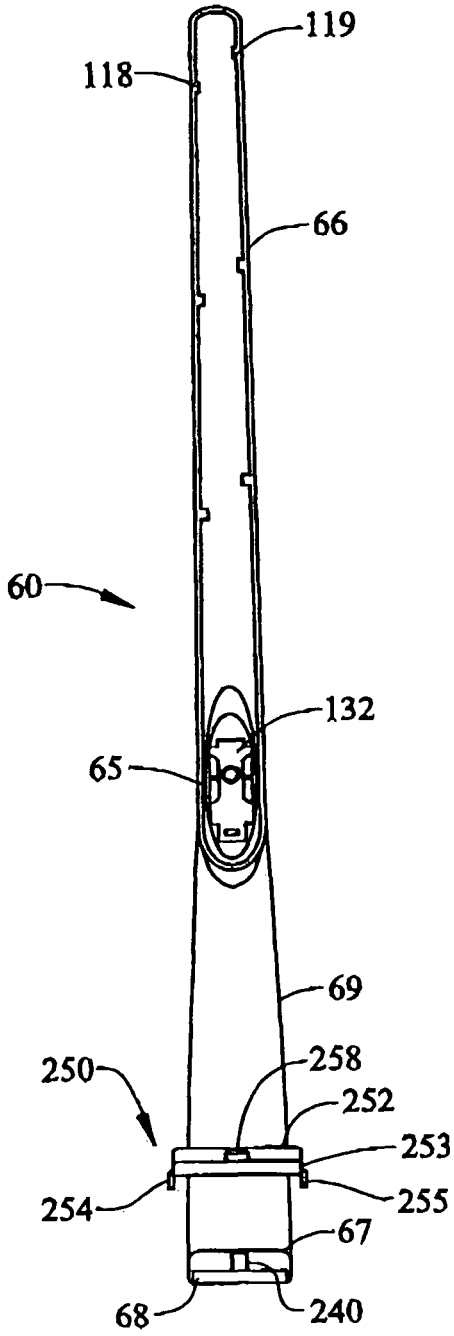
FIG. 4 is a view of an underside of the handle member of FIG. 3.

Reference will now be made to FIGS. 2-4 in describing the preferred mounting of handle assembly 60 in accordance with the present invention and it is to be understood that handle assembly 61 is constructed and mounted in a corresponding manner. With initial reference to FIG. 2, a base plate 75 is shown mounted adjacent upper inner edge portion 28 of fresh food door 15. In accordance with the most preferred embodiment of the invention, base plate 75 includes first, second and third spaced apertures 80-82 which are joined by elongated connecting sections 85 and 86. Each aperture 80-82 is adapted to receive a mechanical fastener (not shown), such as a sheet metal screw, for use in attaching base plate 75 to fresh food door 15. Side flanges 101 and 102 extend from each side of base plate 75, preferably for the entire length thereof. With this arrangement, each side flange 101, 102 defines an undercut for base plate 75 which is adapted to co-act with various tab portions 118 and 119 formed at predetermined locations along elongated extension 66 of handle assembly 60. In the most preferred embodiment of the invention, base plate 75 is molded of plastic. However, base plate 75 could be formed of metal.

In addition, a door clip member 125 is mounted along upper inner edge portion 28 of fresh food door 15, while a handle clip member 130 (best shown in FIG. 5) is mounted to first end portion 65 of handle assembly 60. FIG. 6 best illustrates that, in accordance with the most preferred form of the invention, each door clip member 125 includes a main base section 150 which defines a pair of spaced side connectors 154 and 155. As depicted, each side connector 154, 155 is generally concave in shape, while defining an arcuate or convexly curved lower surface (not separately labeled). Projecting from one end of main base section 150 is a tab member 160. Projecting from another end of main base section 150 is a leg extension 162 provided with a through hole 164, which is shown to be generally rectangular or square in shape. Main base section 150 is also provided with a substantially central aperture (not shown) for receiving a mechanical fastener 166, such as a sheet metal screw, to fixedly secure door clip member 125 to door 18. At this point, it should be realized that the exact configuration and mounting of door clip member 125 can be readily varied without departing from the invention. Further details of door clip member 125 are described in co-pending U.S. patent application Ser. No. 10/295,850 herein incorporated by reference.

Figure 5:
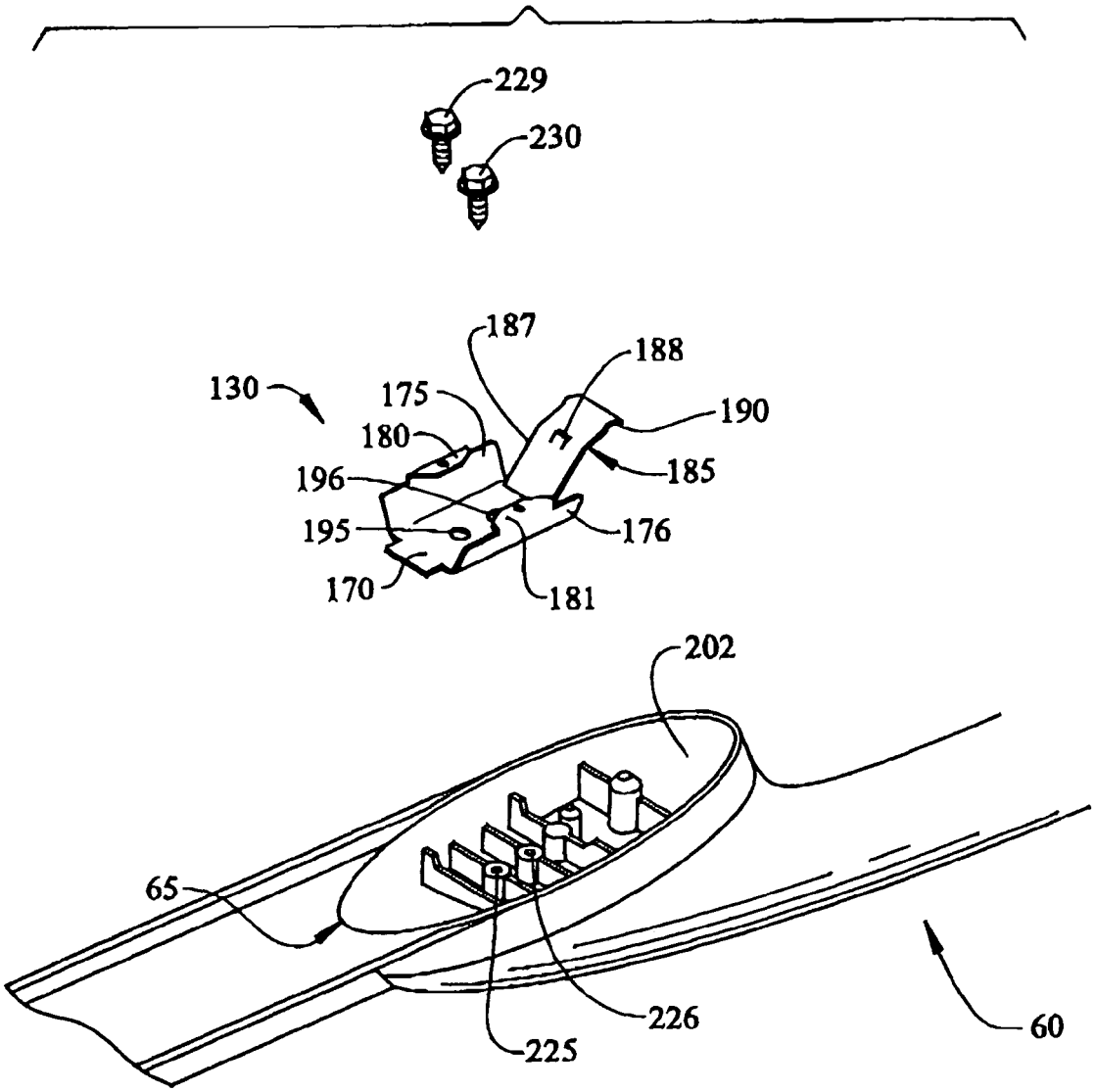
FIG. 5 is an exploded view of the underside of a portion of the handle member of FIGS. 3 and 4.
Figure 6:
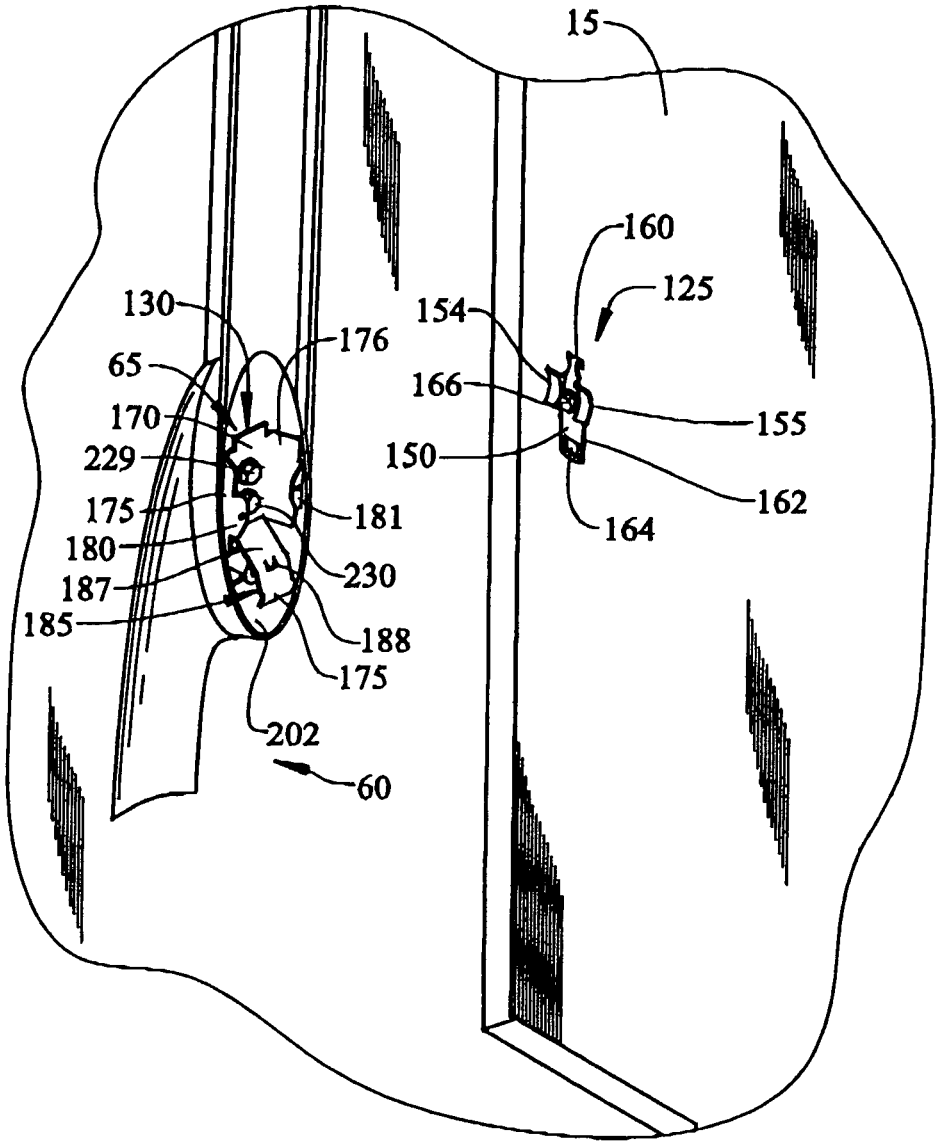
FIG. 6 is a partial exploded view of a mounting arrangement for the handle member of FIGS. 3 and 4.

As best shown in FIGS. 5 and 6, handle clip member 130 includes a base portion 170, upstanding side wall portions 175 and 176, in-turned flange members 180 and 181 stemming from side wall portions 175 and 176 respectively, and a cantilevered arm 185. As shown, arm 185 includes a first angled section 187, a catch section 188 and a terminal portion 190. First angled section 187 preferably projects from base portion 170 a distance greater than the height of side wall portions 175 and 176. In this manner, catch section 188 extends substantially parallel to flange members 180 and 181, while being spaced from base portion 170 a distance greater than flange members 180 and 181. In addition, base portion 170 is preferably provided with a pair of spaced holes 195 and 196.

As best shown in FIG. 5, the underside of first end portion 65 of handle assembly 60 is formed with a recessed section 202 that includes at least bores 225 and 226. In accordance with the most preferred form of the invention, handle clip member 130 is received in recessed section 202, with spaced holes 195 and 196 being aligned with bores 225 and 226. With this arrangement, mechanical fasteners 229 and 230 can be utilized to secure handle clip member 130 to first end portion 65 of handle assembly 60.

With this arrangement, following the mounting of door clip member 125 to door 15 in the manner set forth above, first end portion 65 of handle assembly 60 can be completely laid over door clip member 125, with door clip member 125 being initially arranged adjacent handle clip member 130. Thereafter, the entire handle assembly 60 is shifted or slid relative to door clip member 125 and door 15, thereby causing side connectors 154 and 155 to engage flange members 180 and 181. Due to the shape of side connectors 154 and 155, as handle assembly 60 is shifted in this manner, a wedging action results that causes handle assembly 60 to be drawn against door 15. That is, door clip member 125 and handle clip member 130 includes mating surfaces which co-act along arcuate surfaces to draw handle assembly 60 to the front face portion of door 15. At the same time, tab portions 118 and 119 of extension 66 are positioned in the undercuts defined by side flanges 101 and 102 of base plate 75. In this manner, handle assembly 60 is fixed in position along door 15.

With specific reference to FIGS. 2-4, an important aspect of the invention will now be described. As shown, in-turned portion 68 of second end 67 of handle assembly 60 is provided with a projection 240 extending therefrom for interlocking in-turned portion 68 to horizontal portion 32 of fresh food door 32 when handle assembly 60 is shifted to the fixed position. More specifically, in accordance with a preferred embodiment of the invention, a molded plastic cap 250 is positioned within an opening 251 defined at horizontal portion 32. Plastic cap 250 is arranged in opening 251 to not only cooperate with handle assembly 60 but to also seal an inner portion (not shown) of door 15 to prevent foam leakage during an insulating phase in the formation of door 15. In any case, molded plastic cap 250 includes upstanding walls 252 and 253 and downwardly projecting walls 254 and 255. Upstanding walls 252 and 253 form a friction fit between a periphery of opening 251 and cap 250 to secure cap 250 within opening 251. In-turned portion 68 fits between downwardly projecting walls 254 and 255 when handle assembly 60 is shifted relative to door 15. A socket 258 is integrally formed within molded plastic cap 230 for receiving projection 240 of in-turned portion 68, thereby creating an interlock between in-turned portion 68 and molded plastic cap 250 such that handle assembly 60 is securely attached to door 15 without additional hardware at second end 67. Therefore, when handle assembly 60 is shifted relative to door 15, tabs 118 and 119 of elongated extension 66 co-act with flanges 180 and 181 of base plate 75, handle clip member 132 co-acts with door clip member 125, and in-turned portion 68 interlocks with cap 250 to secure handle assembly 60 against door 15.

With this handle mounting arrangement, handle assembly 60 can be advantageously formed of plastic, preferably with intermediate portion 69 being created through a gas assist operation during molding for gripping purposes, and a tight, aesthetically appealing, as well as easily assembled, overall handle arrangement is defined. In any event, although described with reference to a preferred embodiment of the invention, it should be understood that various changes and/or modifications can be made without departing from the spirit of the invention. For example, handle assembly 60 may be formed without elongated extension 66 or may be attached to door 15 through other means other than handle clip member 130, while still interconnecting handle assembly 60 to door 15 through in-turned portion 68 at horizontal or lateral portion 32. In addition, projection 240, which provides locating, alignment and attachment functions, as well as cap 250, could be replaced by other structure acting between in-turned portion 68 and the door 15, 18 at lateral portion 32 without departing from the invention. In this case, the actual structure of the projection would change, such as to flanges extending from in-turned portion 68 and extending into opening 251. In general, the invention is only intended to be limited in accordance with scope of the following claims.

The invention claimed is:

1. A refrigerator comprising:

a cabinet defining an interior compartment;

a door pivotally mounted to the cabinet for selectively accessing the compartment, said door having a first side edge pivotally attached to the cabinet and a second side edge defined by an upper inner edge portion and a lower inner edge portion which are offset by a lateral portion, said door further having front and back sides, as well as an opening between the front and back sides at the lateral portion;

a cap positioned within the opening of the door; and a handle assembly for pivoting the door relative to the cabinet, said handle assembly including:

a first attachment member fixed to the door adjacent one of the upper and lower inner edge portions;

a handle member including first and second end portions separated by an intermediate portion, said second end portion including an in-turned portion having a projection extending substantially perpendicular therefrom, said handle member being mounted to the front side of the door with the first end portion of the handle member being connected to the first attachment member and the projection of the in-turned portion being received within the opening in the lateral portion of the door.

2. The refrigerator according to claim 1, wherein the cap includes wall portions which are friction fit to the door within the opening.

3. The refrigerator according to claim 1, wherein the cap includes a socket formed therein, said projection extending into the socket.

4. The refrigerator according to claim 3, wherein the cap includes additional wall portions projecting away from the opening, said in-turned portion of the handle member being received between the additional wall portions.

5. The refrigerator according to claim 1, wherein the first end portion of the handle member includes an elongated extension extending therefrom.

6. The refrigerator according to claim 5, wherein the first attachment member is a base plate about which the first end portion extends.

7. The refrigerator according to claim 1, wherein the first attachment member is a door clip member, said door clip member being covered by the first end portion of the handle member.

8. The refrigerator according to claim 7, wherein the first end portion of the handle member has a recessed portion formed therein and into which the door clip member is received.

9. The refrigerator according to claim 8, further comprising: a handle clip member mounted in the recessed portion, said handle clip member mating with the door clip member to mount the handle member on the front side of the door.

10. The refrigerator according to claim 1, further comprising: a second attachment member fixed to the door adjacent the one of the upper and lower edge portions at a position vertically spaced from the first attachment member, said first end portion of the handle member being connected to each of the first and second attachment members.

11. The refrigerator according to claim 10, wherein the second attachment member is a door clip member, said door clip member being covered by the first end portion of the handle member.

12. The refrigerator according to claim 11, wherein the first end portion of the handle member has a recessed portion formed therein and into which the door clip member is received.

13. The refrigerator according to claim 12, further comprising: a handle clip member mounted in the recessed portion, said handle clip member mating with the door clip member to mount the handle member on the front side of the door.

14. A method of attaching a handle assembly to a refrigerator door having a first side edge adapted to be pivotally attached to a refrigerator cabinet and a second side edge defined by an upper inner edge portion and a lower inner edge portion which are offset by a lateral portion, said door further having front and back sides, as well as an opening between the front and back sides formed in the lateral portion, said method comprising:

fixedly securing an attachment member to the front side of the door adjacent one of the upper and lower inner edge portions;

sliding a handle member along the front side of the door to interconnect a first end portion of the handle member to the attachment member;

drawing an in-turned portion of the second end portion of the handle member to the lateral portion of the door, with a projection extending substantially perpendicular from a second end portion of the handle member being received in the opening formed in the lateral portion of the door; and attaching a cap in the opening prior to the protection being received in the opening.

15. The method of claim 14, further comprising: positioning the projection in a socket formed in the cap.

16. A method of attaching a handle assembly to a refrigerator door having a first side edge adapted to be pivotally attached to a refrigerator cabinet and a second side edge defined by an upper inner edge portion and a lower inner edge portion which are offset by a lateral portion, said door further having front and back sides, as well as an opening between the front and back sides formed in the lateral portion, said method comprising:

fixedly securing an attachment member to the front side of the door adjacent one of the upper and lower inner edge portions;

sliding a handle member along the front side of the door to interconnect a first end portion of the handle member to the attachment member and simultaneously drawing the handle member to the front side of the door upon sliding the handle member to connect the first end portion to the attachment member; and drawing an in-turned portion of the second end portion of the handle member to the lateral portion of the door, with a projection extending substantially perpendicular from the second end portion of the handle member being received in the opening formed in the lateral portion of the door.

* * * * *